US006866156B2

(12) United States Patent
Nagel et al.

(10) Patent No.: US 6,866,156 B2
(45) Date of Patent: Mar. 15, 2005

(54) ADJUSTABLE WIDTH PRODUCT DISPLAY SYSTEM

(75) Inventors: Thomas O. Nagel, Blairstown, NJ (US); Russell M. Moyer, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 31 days.

(21) Appl. No.: 10/406,984

(22) Filed: Apr. 4, 2003

(65) Prior Publication Data

US 2004/0004047 A1 Jan. 8, 2004

Related U.S. Application Data

(62) Division of application No. 10/024,153, filed on Dec. 17, 2001, now Pat. No. 6,719,152.

(51) Int. Cl.[7] ..... A47P 7/00
(52) U.S. Cl. ..... 211/59.3
(58) Field of Search ..... 211/59.2, 49.1, 211/59.4, 50, 51, 59.3, 175, 184; 221/304

(56) References Cited

U.S. PATENT DOCUMENTS

| | | | | |
|---|---|---|---|---|
| ,573,835 A | | 12/1896 | Taylor | |
| 1,703,987 A | | 10/1926 | Butler | |
| 2,079,754 A | | 7/1935 | Waxgiser | |
| 2,625,162 A | | 1/1953 | Edeborg | |
| 3,110,402 A | | 11/1963 | Mogulescu | |
| 3,308,961 A | * | 3/1967 | Chesley | 211/59.3 |
| 3,417,875 A | | 12/1968 | Barker | |
| 3,780,873 A | * | 12/1973 | Silva | 211/59.3 |
| 4,130,203 A | | 12/1978 | Russell, III | |

FOREIGN PATENT DOCUMENTS

| | | |
|---|---|---|
| GB | 1299451 | 12/1972 |
| JP | 407163445 A | 6/1995 |

(List continued on next page.)

*Primary Examiner*—Hugh B. Thompson, II
*Assistant Examiner*—Sarah Purol
(74) *Attorney, Agent, or Firm*—Schweitzer Cornman Gross & Bondell LLP

(57) ABSTRACT

An adjustable width product display system which includes spaced-apart front and back display supports formed of an engineering plastic material, suitable for food freezer environments. Formed wire side elements, provided with transversely extending mounting portions, are slideably received in transversely disposed recesses in the plastic display supports. Each display support includes a pair of closely adjacent, parallel recesses for receiving the mounting portions in overlapping relation, providing a wide range of width adjustment to accommodate packages of different size. A wire frame, comprising a pair of elongated wire elements extending from front to back of the display system joins the two display supports in spaced relation. These wire elements also function as an underneath support for product packages confined between the side elements. Laterally adjacent elements can be connected in series by intermediate wire side supports provided with transverse mounting elements extending in opposite directions and engagable in plastic display supports on both sides. Product pusher means are easily incorporated into the product display system either in the form of a preassembled pusher device, or the use of a spring-driven pusher sled mounted on the wire elements connecting the front and back display supports. The system, is ideally suited for food freezer environment, because plastic materials are minimally present in the structure and thus can be of a suitable engineering grade material. Additionally, the open wire structure accommodates free circulation of air in a freezer compartment to help maintain the desired environment throughout the compartment.

5 Claims, 10 Drawing Sheets

U.S. PATENT DOCUMENTS 4,346,806 A 8/1982 Bustos
4,899,893 A 2/1990 Robertson
5,366,099 A 11/1994 Schmid
5,390,802 A 2/1995 Pappagallo et al.
5,449,076 A * 9/1995 Van Noord ..... 211/59.3
5,458,248 A 10/1995 Alain
5,464,105 A 11/1995 Mandeltort
5,730,320 A 3/1998 David
5,855,283 A 1/1999 Johnson
6,116,436 A 9/2000 Ferrucci et al.
6,142,317 A 11/2000 Merl
6,155,438 A 12/2000 Close
6,161,708 A 12/2000 Myler
6,164,462 A 12/2000 Mumford
6,299,004 B1 10/2001 Thalenfeld et al.
6,357,606 B1 3/2002 Henry

* cited by examiner

FIG.12
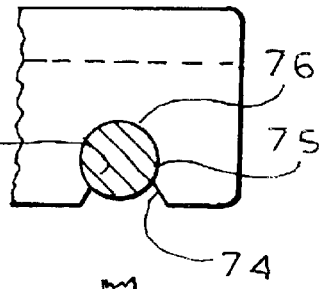
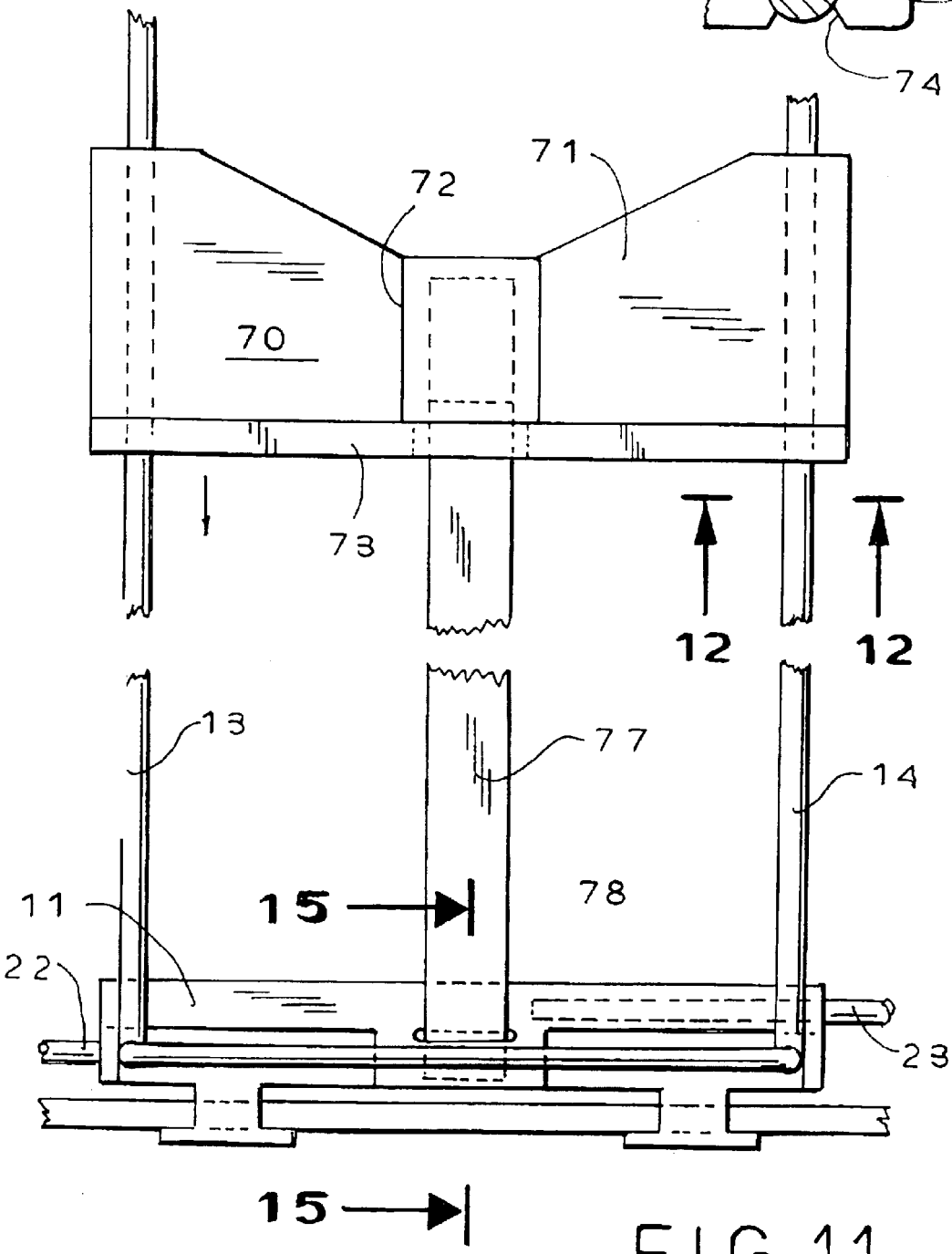
FIG.11

ADJUSTABLE WIDTH PRODUCT DISPLAY SYSTEM

This application is a division of my application Ser. No. 10/024,153, filed Dec. 17, 2001, now U.S. Pat. No. 6,719, 152, granted Apr. 13, 2004.

BACKGROUND OF THE INVENTION

In the display of products in stores and supermarkets, it is frequently desirable to employ shelf organizing systems that facilitate alignment of similar product items in a front-to-back column, neatly aligned and presenting an attractive display to the customer. Inasmuch as different product items occupy different amounts of space on the display shelves, such organizers frequently accommodate width adjustment, so that narrow packages can be aligned in a narrow column and wider packages in a wider column. A wide variety of devices and systems are available for this general purpose. Typically, however, known systems suffer from various disadvantages including excessive cost and complication, unsuitability for certain environments, such as use in freezers for the display of frozen foods, etc.

SUMMARY OF THE INVENTION

The present invention is directed to an improved and simplified form of product display system in which the component parts are reduced to a bare minimum of elemental components, which nevertheless perform the necessary functions in a superior manner. Additionally, the product display system of the invention is especially suitable for use in freezer compartments, for example, while at the same time being equally suitable for use in connection with conventional shelf displays.

For the display of products in a food freezer environment, standard plastic materials commonly used in display systems are not well suited, because of a tendency to crack and break in the low temperature environment. While engineering plastic materials are available which will withstand the cold environment, such materials are rather costly and thus economically unsuitable to be substituted for ordinary plastic materials in systems of conventional design. Pursuant to the present invention, a product display system is provided in which the elements thereof are formed principally of steel wire, and plastic components are utilized in a critical way but in only a minimal amount. Accordingly, it is altogether feasible to utilize appropriate engineering plastics, such as "Celcon"™ for the plastic components. The display system of the invention is also ideally suited for use in the display of frozen food products, for example, because the primary use of wire components, and the minimal use of plastic components, provides for a wide open structure, accommodating free circulation of air within the freezer compartment. Such circulation is particularly important to maintain proper storage of the frozen products and can be significantly inhibited by display systems of conventional design making extensive use of plastics, sheet metal or the like in their construction.

In a preferred embodiment of the invention, a display system incorporates a pair of spaced-apart front and back display supports formed of molded plastic material and extending transversely of a front-to-back axis of the system. These plastic display supports may be minimally dimensioned, and may be formed of a suitable engineering plastic material. Each of the plastic display supports is provided with transverse recesses for the slideable reception of wire side supports which extend from the front display support to the back display support and define an adjustable width space for the alignment of product items between the front and back display supports. Opposite side supports are received in separate recesses in the display supports, which are arranged in side-by-side, parallel relation such that, in a minimum width configuration of the system, transversely disposed mounting elements of the side supports, which are received in the recesses, are arranged in overlapping relation. By adjusting the side supports transversely toward and away from the front and back display supports, the width of the product guide channel can be readily adjusted to the width of the product, as will be understood.

In a preferred and illustrated form of the invention, a rectangular main frame is provided, which is of wire construction and includes spaced-apart side elements extending between the front and back display supports, and transverse wire elements extending between the two side elements. The front and back display supports are provided with snap-in grooves for the reception of the transverse wire elements, enabling the display supports to be tightly attached to the wire frame. At its forward end, the wire frame may be formed with upright elements forming a front stop for product packages being urged forwardly by a clerk or by automatic pusher means. The wire frame also serves to provide a bottom support or "floor" for product packages confined between the adjustably positioned side elements.

Pursuant to the invention, the front and back display supports are constructed to accommodate positioning on a flat display shelf, for example, and also to be supported within a freezer compartment, advantageously by being supported exclusively at the front and the back, providing free air circulation within the freezer compartment, and also accommodating lateral sliding movement of the display device, if desired, for access to lower areas of the compartment.

The display system of the invention accommodates side-by-side assembly of a series of display units, as a unitary structure, while at the same time providing that each of the units is separately width adjustable. This is accomplished by providing intermediate side supports in which transverse wire mounting elements are slideably engaged with front and back display supports on opposite sides. The intermediate side support thus connects adjacent product display units together, while accommodating width adjustment of each independently.

In certain configurations, the display system of the invention can advantageously incorporate spring-loaded pusher mechanisms that serve to urge product packages to forwardmost positions in the display. Such pusher mechanisms are, in general well known. Nevertheless, the system of the invention incorporates advantageous improvements for simplified manufacture and operation and lower cost. In one form of the invention, the display supports and the associated wire frame are configured to receive a pre-assembled pusher unit, which is conveniently snapped in place at the front and back of the structure and provides the desired product pusher operation. In another advantageous embodiment, a specially designed pusher sled is provided which is snapped over side wires of the main frame and uses those wires as a guide track for its movement. A coiled strip spring, housed in the sled, attaches to the front display support and provides the desired spring action to urge product packages to the front of the display.

For a more complete understanding of the above and other features and advantages of the invention, reference should be made to the following detailed description of preferred embodiments of the invention, and to the accompanying drawings.

DESCRIPTION OF THE DRAWINGS

FIG. 11 is a fragmentary top plan view of a modified form of the new system incorporating a modified form of pusher system.

FIG. 12 is an enlarged, fragmentary cross sectional view as taken generally along 12—12 of FIG. 11.

DESCRIPTION OF PREFERRED EMBODIMENTS OF THE INVENTION

Figure 7:
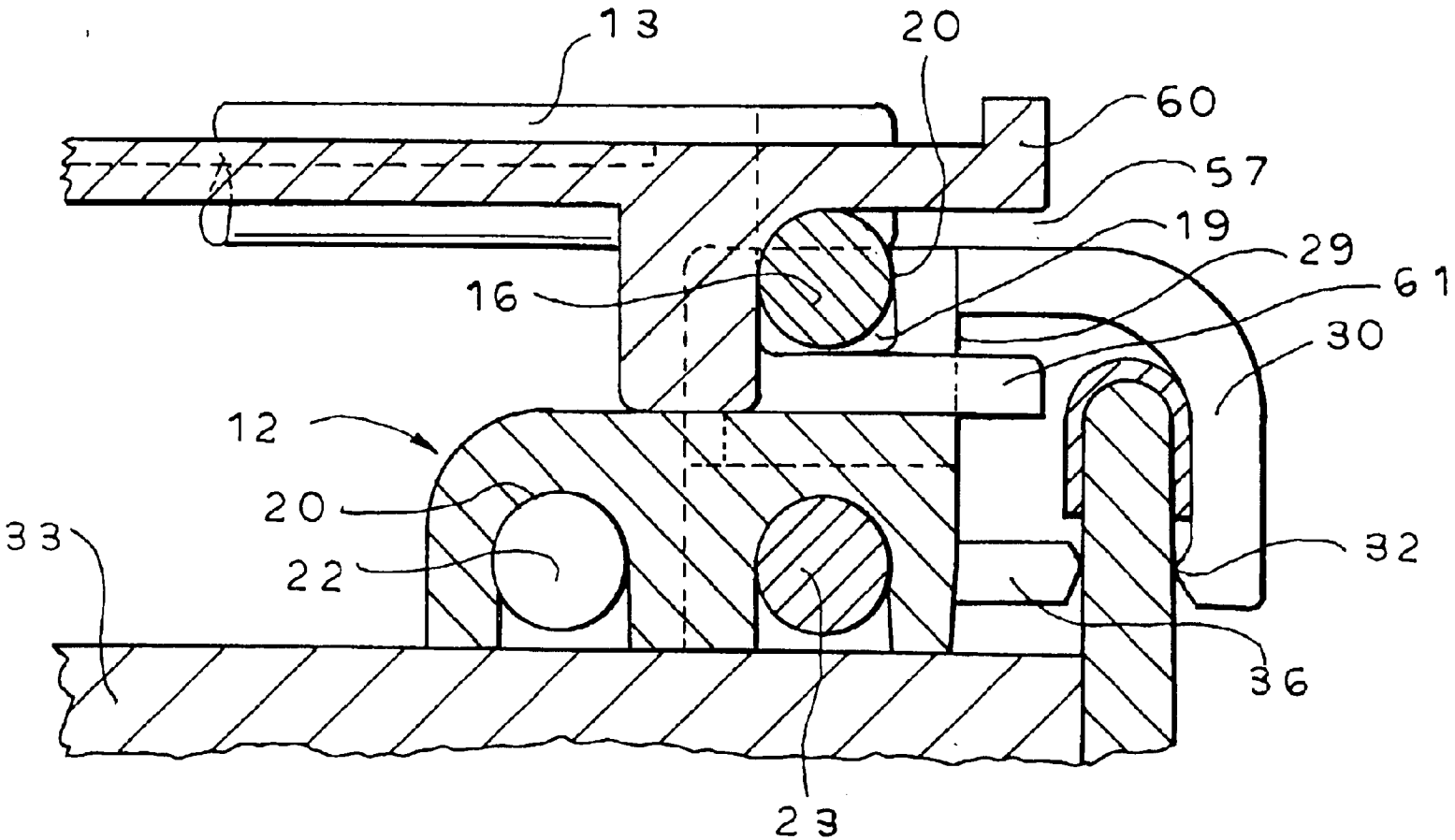
FIG. 7 is an enlarged, fragmentary cross sectional view as taken generally on line 7—7 of FIG. 6.
Figure 8:
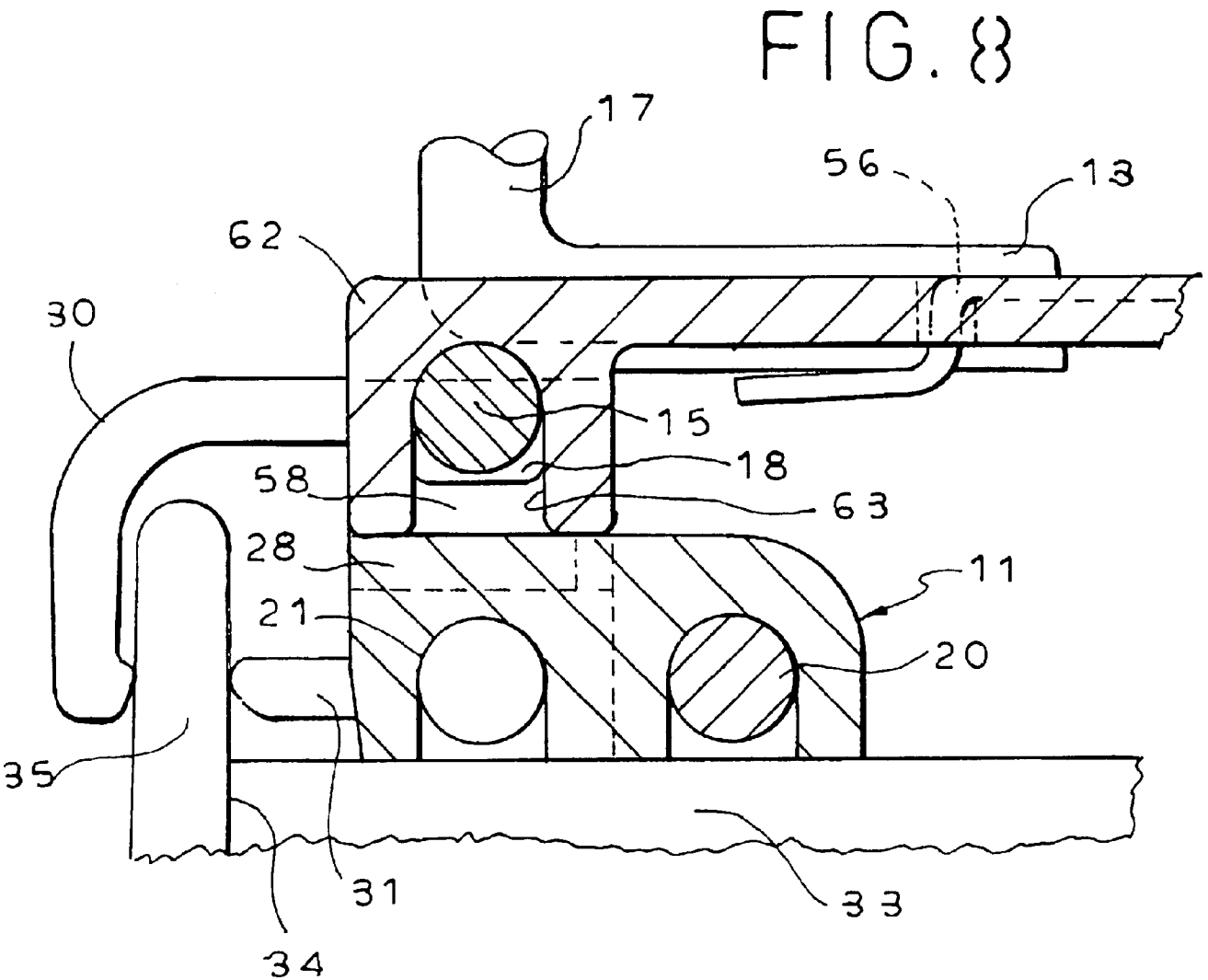
FIG. 8 is an enlarged, fragmentary cross sectional view as taken generally along line 8—8 of FIG. 6.
Figure 9:
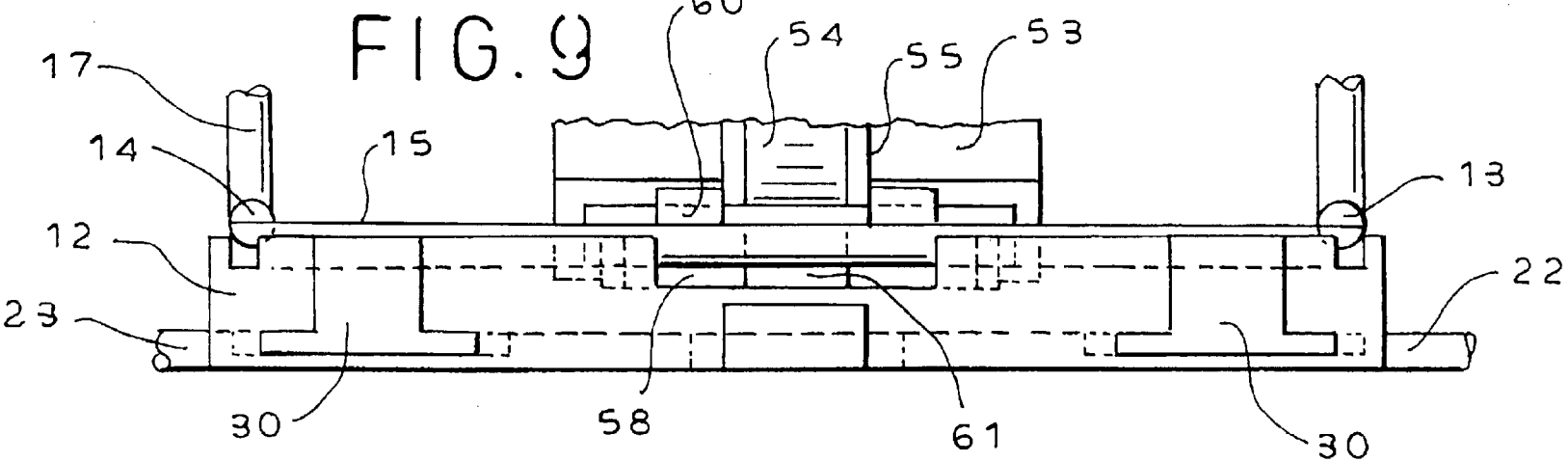
FIG. 9 is an enlarged, fragmentary back elevational view of the system of FIG. 6.
Figure 10:
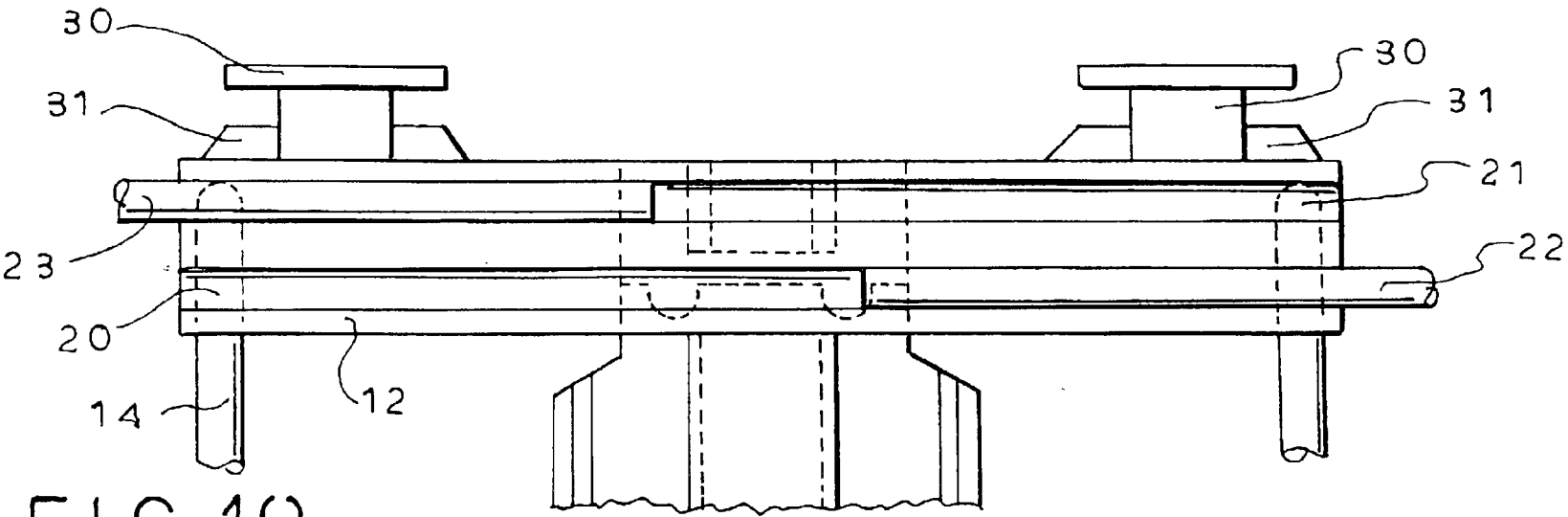
FIG. 10 is an enlarged, fragmentary bottom plan view of the structure of FIG. 9.
Figure 13:
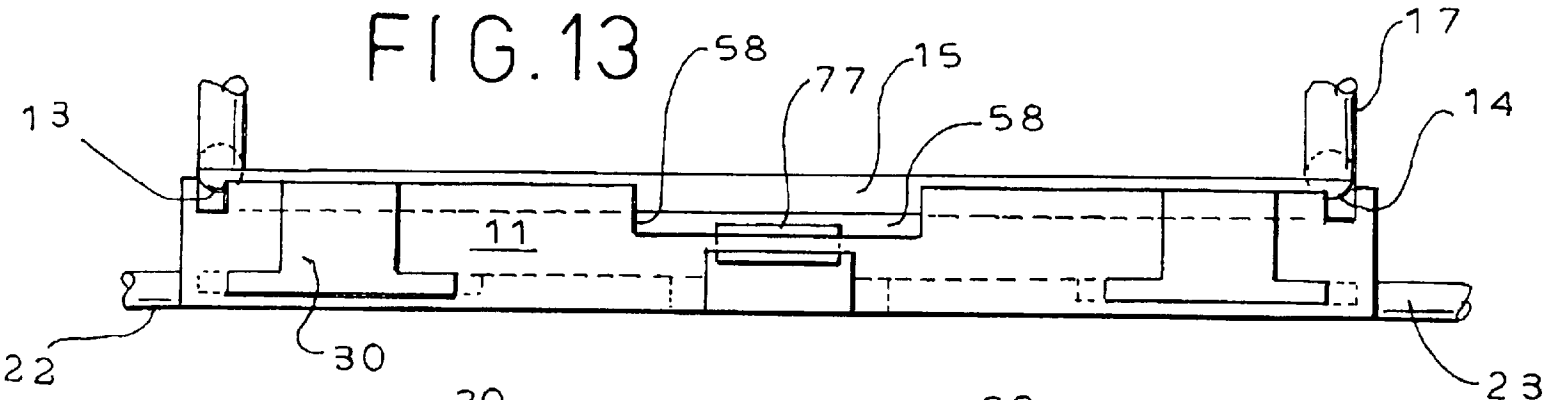
FIG. 13 is a fragmentary front view of the subject matter of FIG. 11.
Figure 14:
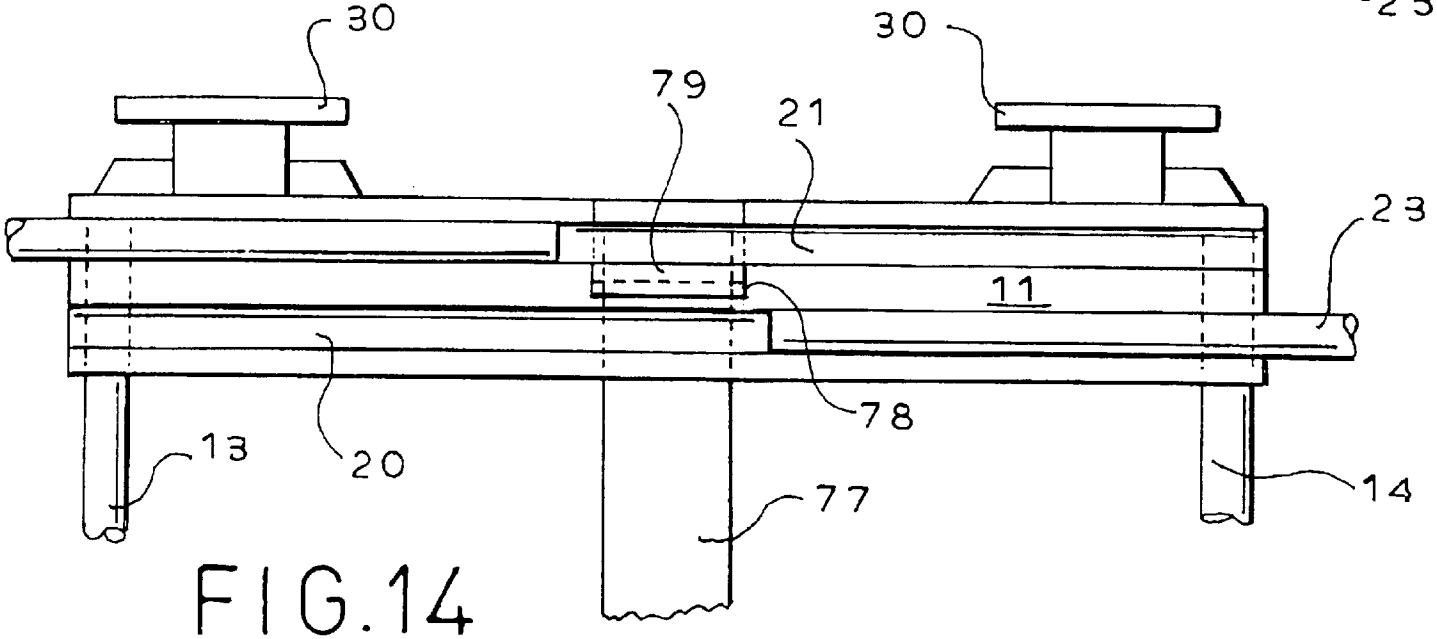
FIG. 14 is a bottom plan view of the subject matter of FIG. 13.
Figure 15:
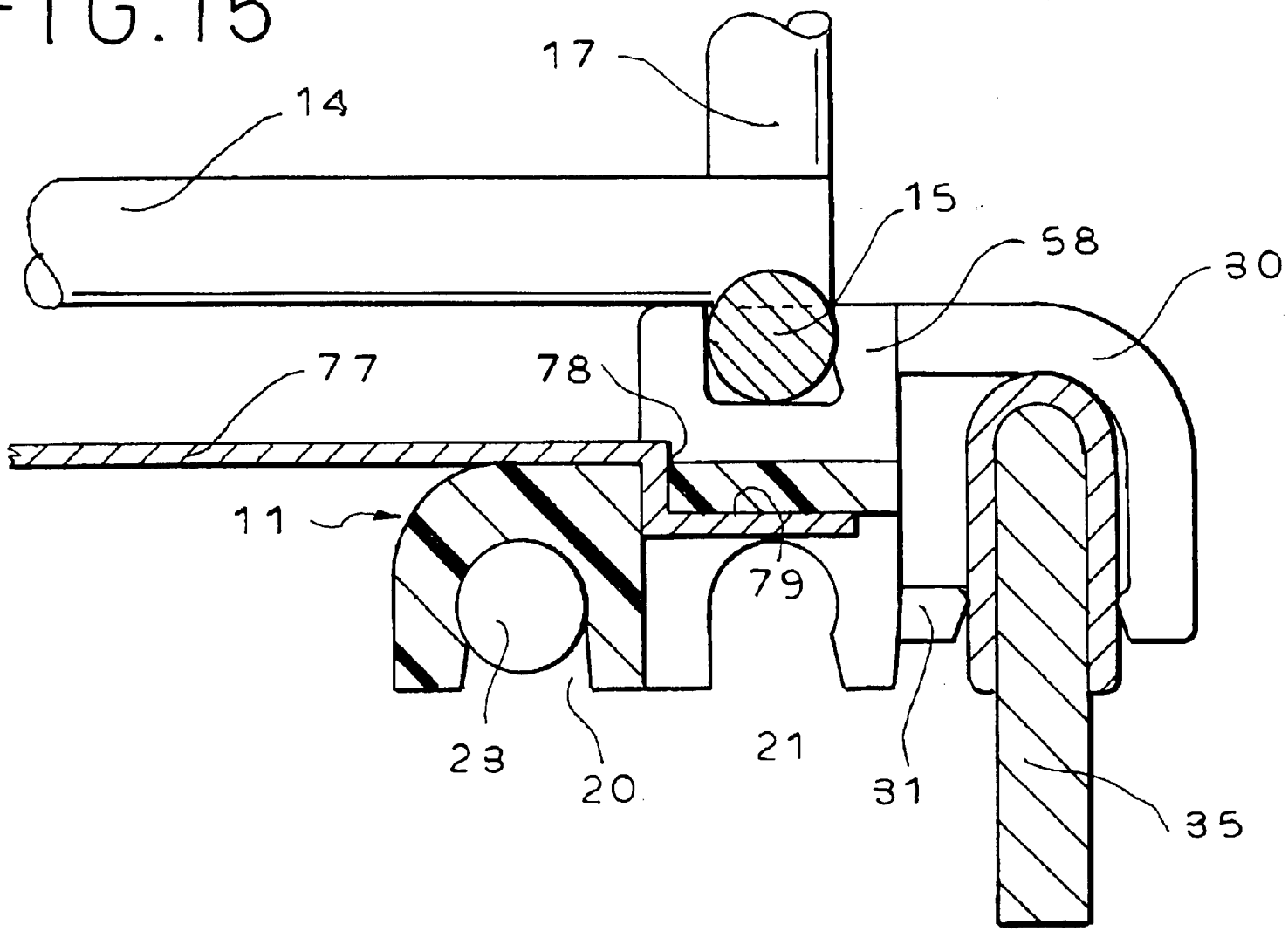
FIG. 15 is an enlarged, fragmentary cross sectional view as taken generally on line 15—15 of FIG. 11.

Referring now to the drawing, the product display system 10 of the invention comprises front and back display supports 11, 12 formed of molded plastic material. The display supports 11, 12, which will be described in more detail are joined by a pair of spaced, parallel side wires 13, 14. In a particularly preferred embodiment of the invention, the elongated side wires 13, 14 form part of a rectangular main frame, being joined at their front and back end extremities by transverse wires 15, 16. To advantage, the transverse wires 15, 16 are secured to the side wires 13, 14 by welding. At the front of the structure, an upright stop element 17, advantageously in the form of a wire loop, is provided to limit forward movement of product items positioned within the display apparatus. To advantage, the loop 17 may be formed integrally with the side wires 13, 14, or may be welded thereto, as desired. In the illustrated form of the invention, the transverse wires 15, 16 are welded underneath the elongated side wires 13, 14, as indicated in FIGS. 7 and 8, for example.

The respective front and back display supports 11, 12 preferably are identical plastic moldings, and particularly for use in freezer compartments for example the plastic material for these moldings is of an engineering grade, such as Celcon, an acetal polymer made available by Hercules (now Ticonia (Celanese)). The display supports are of transversely elongated configuration and have approximately the same length, in the transverse direction, as the width of the rectangular wire main frame. In the upper portion of each display support are transverse grooves 18, 19, which are upwardly opening and extend most of the way across the top of the respective display supports. Preferably, the display supports are slightly longer than the front and back connecting wires 15, 16 of the main frame, and the grooves 18, 19, while at least slightly longer than the respective connecting wires 15, 16, are closed at opposite ends to provide lateral confinement for the connecting wires. In a preferred embodiment of the invention, the transverse grooves 18, 19 are of somewhat greater depth than the radius of the connecting wires 15, 16, and are formed with constricted entrances (see 20, FIG. 7), such that the connecting wires 15, 16 may be forced downwardly into the grooves 18, 19 with a snap fit, and will be thereafter locked together with the display supports 11, 12, unless intentionally removed. Thus, in a typical structure according to preferred embodiments of the invention, the wire main frame and the front and back display supports form a unitary structure.

In their bottom portions, the display supports 11, 12 are formed with a pair of closely spaced, parallel passages 20, 21 extending transversely across the full width of the display support. The passages 20, 21 adapted to snugly but slideably receive transversely disposed mounting portions 22, 23 of side support elements 24, 25 formed of wire. Preferably, the side support elements 24, 25 are of the same dimensions on opposite sides and are mounted in slightly offset relation on opposite sides of the display supports 11, 12, as is reflected in FIG. 1. Thus, the transverse mounting portions 22 of the side support 24 are received in the forwardly positioned recess 21 of the front display support 11, and in the forwardly positioned recess 20 of the back display support 12 (see FIGS. 7, 8). Likewise, the transversely disposed mounting portions 23 of the opposite side support element 25 are snugly but slideably received in the rearmost recess 21 of the back display support 12 and also the rearmost recess 20 of the front display support 11. Although the recesses 20, 21 may be of cylindrical form, it is preferable to provide them in the form of downwardly opening recesses, to better accommodate the molding process. The downwardly opening recesses are configured to define more than 180 degrees of a cylinder, such that the wire elements 22, 23 are firmly retained therein. Additionally, while accommodating sliding movement of the wire mounting portions 22, 23, the recesses 20, 21 grip the wire elements sufficiently tightly that the side elements 24, 25 will be held in any adjusted position by frictional contact.

To greatest advantage, the length of the transverse wire mounting elements 22, 23 is at least as great as the length, in the transverse direction, of the display supports 11, 12. Thus, when the respective side supports 24, 25 are moved to an adjusted position in which the longitudinally extending side elements 26, 27 of the side supports are positioned tight against the ends of the display supports 11, 12, the mounting portions 22, 23 will extend in side-by-side, overlapped relation entirely through the display supports. This provides for a maximum outward adjustment of the side supports while retaining adequate connecting contact between the mounting elements 22, 23 and the respective display support recesses 20, 21. The range of width adjustment of the side supports 24, 25 is thus maximized, as will be readily understood.

Figure 1:
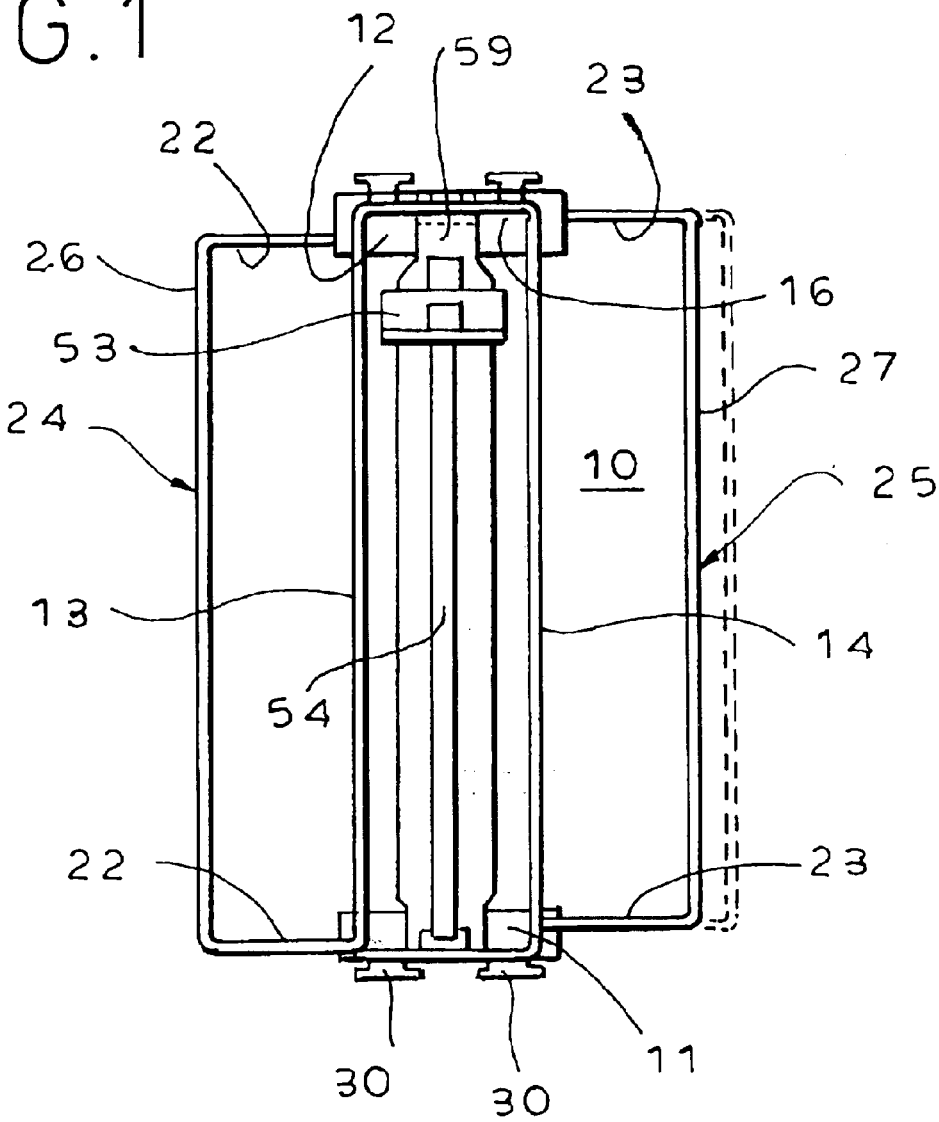
FIG. 1 is a top plan view of one preferred form of the product display system of the invention.
Figure 2:
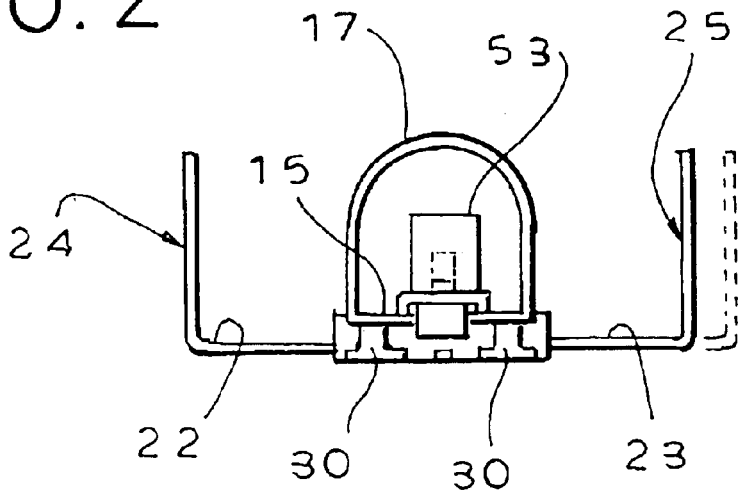
FIG. 2 is a front elevational view of the system of FIG. 1.

In the illustrated and preferred form of the invention, the display supports 11, 12 are provided along their outwardly facing (i.e., forward, backward) surfaces 28, 29 with downwardly projecting guide hooks 30, which extend outward from upper portions of the display supports and then arc downwardly as shown in FIGS. 7 and 8. Typically, a spaced apart pair of such hooks is provided on each display support, as indicated in FIGS. 1 and 2, for example. Preferably, spacer elements 31 project outward from the display supports toward the guide hooks, to define an entrance throat 32.

In the arrangement shown in FIGS. 7 and 8, the display system is supported on a shelf 33 provided along at least its front edge 34 (FIG. 8) with a guide track 35. In some shelf configurations, a similar guide track 36 may be provided along the back edge of the shelf or at an intermediate location. The guide track 35 serves to position the display system uniformly on the display shelf, and allows it to be adjusted easily from side to side along the display shelf while maintaining the alignment and orientation of the display system. Additionally, in certain display environments, such as food freezer displays, for example, the display system of the invention preferably can be suspended exclusively by guide tracks 35, 36 at each end, providing for free circulation and also enabling the display structures to be moved laterally to gain access to areas below in the freezer compartment.

In the display system of the invention, multiple units may be joined side-by-side, in various numbers, to accommodate display assemblies of various widths. This is accomplished in the manner reflected in FIGS. 4 and 5 which show a pair of side-by-side display units, designated generally by the reference numerals 40, 41. Each is constructed substantially in the manner described with respect to FIGS. 1–3, except that a special intermediate side support element 42 is provided between adjacent units. The intermediate side support 42 comprises transverse mounting portions 43, 44 extending in opposite directions from a central longitudinally extending support wire 45. The transverse mounting portions 43, 44 preferably constitute single wire sections, joined to opposite ends of the support wire 45 by welding.

Figure 3:
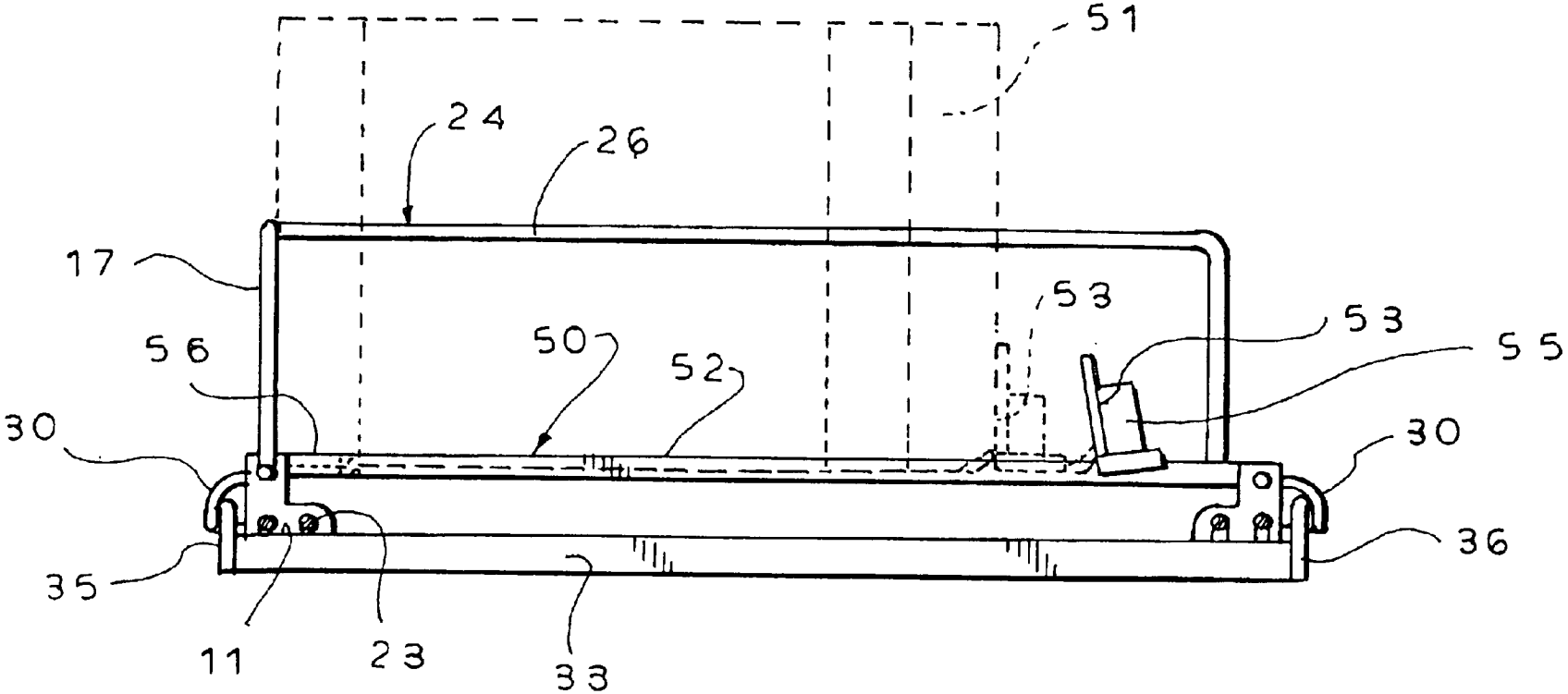
FIG. 3 is a side elevational view of the system of FIG. 1.
Figure 4:
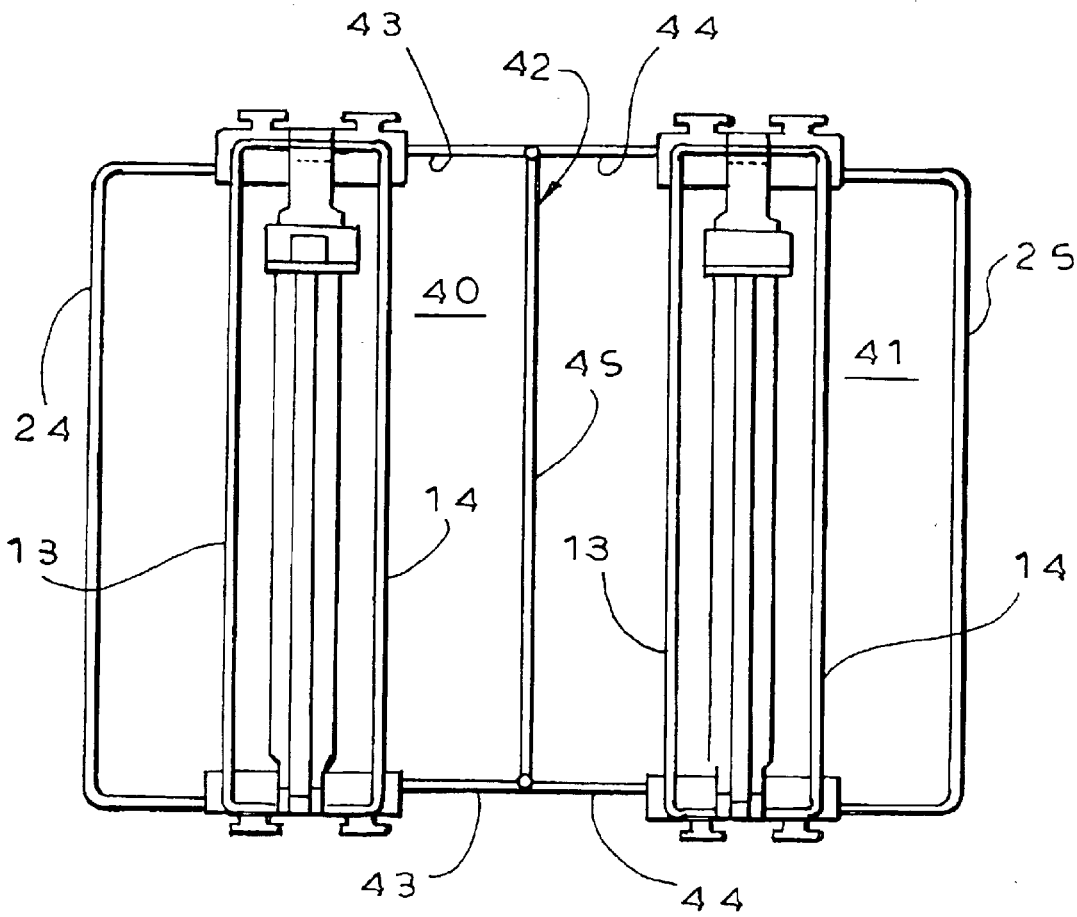
FIG. 4 is a top plan view of a modification of the system shown in FIG. 1, in which a plurality of product confinement units are provided, using a common adjustable divider between adjacent units.
Figure 5:
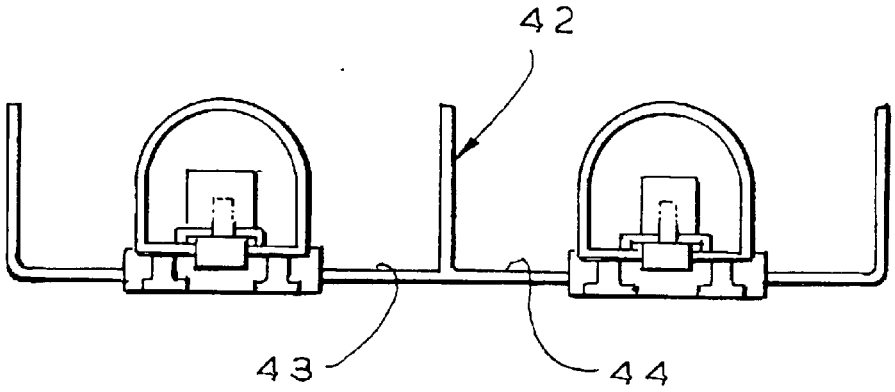
FIG. 5 is a front elevational view of the system of FIG. 4.
Figure 6:
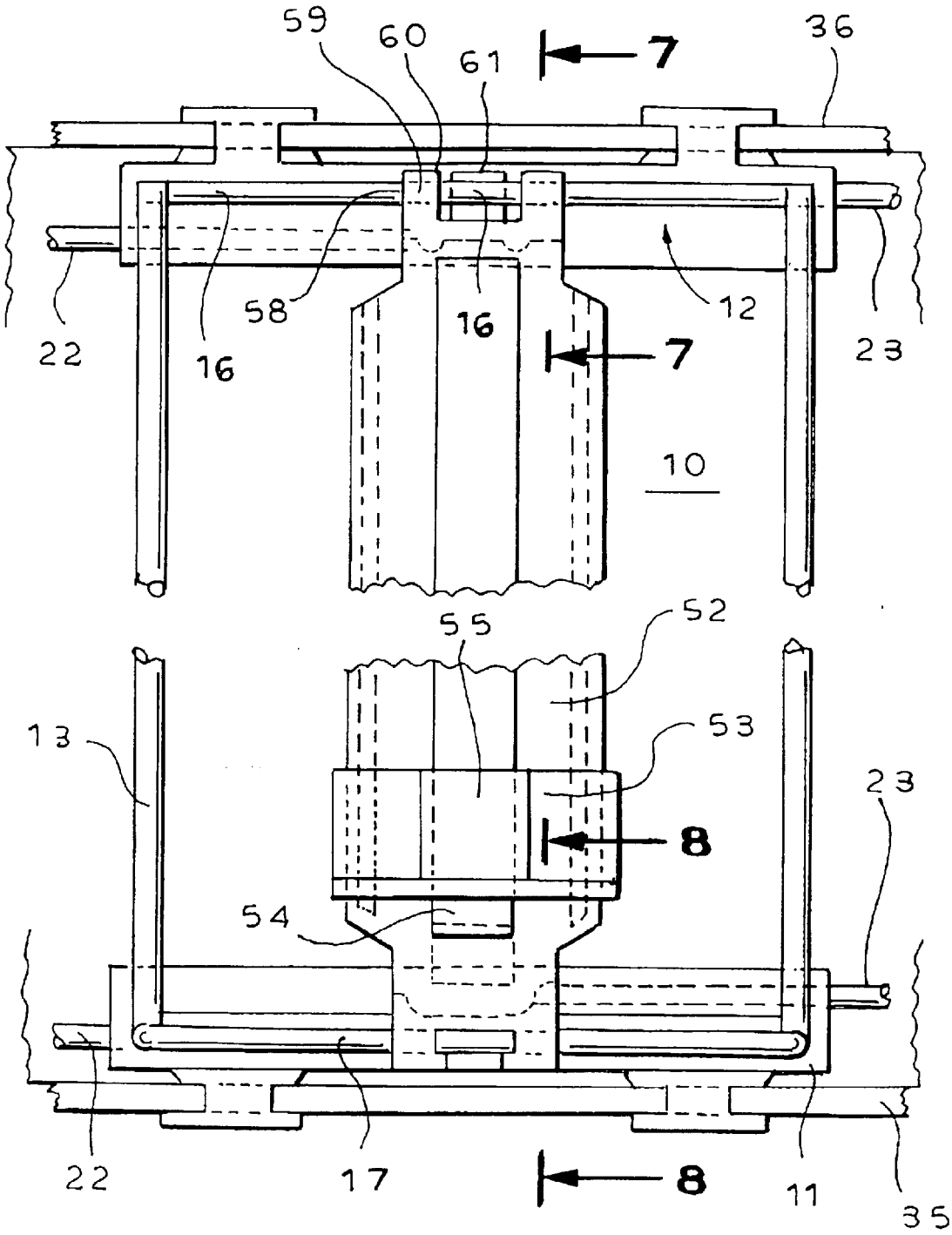
FIG. 6 is an enlarged, fragmentary top plan view, similar to FIG. 1 but showing additional detail.

As reflected in FIGS. 4 and 5, the mounting portions 43, 44 are joined with the display supports 11, 12 of the respective display units 40, 41 in the same manner as described in connection with FIGS. 1–3. Each of the mounting portions 43, 44 is adjustably associated with its display support, such that each of the display units 40, 41 is separately adjustable in width, while the two adjacent units remain connected together.

As will be readily apparent, by incorporating additional display units, each joined to its neighbor by one of the special intermediate side elements 42, any number of display units may be connected together side-by-side.

In its most basic form, a display unit of the invention consists of the elements described, in which packages are supported on the longitudinally extending wires 13, 14 and confined laterally by the respective side supports 24, 25 (and 45 in the case of multiple side-by-side units). Preferably, however, it is also desirable to utilize a product pusher mechanism, such as that generally designated by the reference numeral 50 in FIGS. 1–10, to act on the rearwardmost package of a column thereof (FIG. 3) to urge the packages forwardly, against the front stop 17. An advantageous form of pusher mechanism for this purpose is one which is described and claimed in the copending application Ser. No. 10/024,156, filed Dec. 17, 2001 of David R. Thalenfeld, assigned to the assignee of this application, Trion Industries, Inc. Reference can be made to that copending application for additional details relating to the pusher mechanism 50.

The pusher mechanism 50 shown in FIGS. 1–10 includes an elongated guide track 52, which confines and guides a pusher sled 53. A coiled strip spring 54 has its coil body contained within a housing 55 in the pusher sled and extends forwardly from the sled to an anchor point 56 at the front end of the guide track. The spring constantly urges the sled in a forward direction, urging the package column to the front of the display unit.

To advantage, the guide track 52 includes a rearwardly opening recess 57 (FIG. 7) at its back end which is arranged to receive the back transverse wire element 16 of the main frame. To this end, the display supports 11, 12 are provided in their center portions with upwardly opening notches 58 (FIG. 9) which expose a center portion of the wire 15 or 16. As is evident in FIGS. 6 and 7, a somewhat narrowed tongue section 59, at the back of the guide track 52, is dimensioned to be received closely within the notch 58 in the display support, with upper and lower elements 60, 61 of the tongue straddling the transverse wire 16, from above and below to provide a snap-on connection. The back tongue of the guide strip 52 is attached to the wire 16 by inserting it into the notch 58 and pushing rearwardly, to engage the wire by the tongue elements 60, 61.

At the forward end of the pusher assembly there is also a narrowed tongue portion 62, which is received closely within the notch 58 in the front display support 11. The narrowed tongue 62 has a downwardly opening recess 63, which, when the guide strip is pressed downwardly, tightly engages the transverse wire 15 of the main frame with a snap-on connection, as reflected in FIG. 8. The described pusher assembly 50 is thus easily installed in the adjustable width display unit. The guide track 52 is preferably considerably narrower than the space between the longitudinal frame wires 13, 14, as is generally indicated in the drawings.

Typically, the pusher assembly is formed principally of plastic materials and is best adapted for non-freezing compartment utilization, unless made of a suitable low temperature resistant plastic material.

An alternative embodiment of the invention shown in FIGS. 11–15 utilizes a modified and simplified form of product pusher mechanism. The modified pusher mechanism of FIGS. 11–15 functionally incorporates portions of the display unit itself, as distinguished from the pusher mechanism of FIGS. 1–10, which is essentially a self-contained, pre-assembled unit which is simply snapped into place in the display unit as previously described.

In the embodiment of FIGS. 11–15, a pusher sled 70, formed of molded plastic, is comprised of a generally horizontal main platform 71, a spring housing 72, and a vertically extending pusher panel 73. At each side, the sled 70 is formed with downwardly opening guide channels 74 (FIG. 12) which are configured to have a narrowed throat section 75 for snap-on assembly with the main frame wires 13, 14 of the display unit. Beyond the throat, the recesses are preferably of generally cylindrical contours, as indicated at 76, fitting loosely enough with the wire 14 to accommodate easy front and back sliding movement of the sled 70 on the frame wires 13, 14. A coiled strip spring 77 has its coiled body contained within the sled housing 72, and its free end extending forwardly and anchored by means of a slotted opening 78 in the front display support 11. Since both display supports 11, 12 are of identical construction, the rear support also has a slotted opening 76, but it is nonfunctional in the illustrated embodiment. Preferably, the free end of the spring is formed with an offset 79 which, when passed through the slotted opening 78, serves to lock the spring end to the display support.

In the illustration of FIG. 16, the display system is shown in a typical installation in a freezer compartment, for example. In such cases, the display units are supported at opposite ends only, by means of guide tracks, such as the track 35 shown in FIG. 15. The interior of the freezer compartment is thus kept open for the relatively free circulation of air within.

In any of its forms, the display system of the invention has important advantages in terms of simplicity and low cost, while at the same time providing improved functionality. The plastic display supports utilize a minimal amount of plastic material, and thus can be formed of an engineering grade material suitable for use in the cold environment of a food freezer. In a typical display unit of the invention, the plastic display supports may be less than six inches in length, with a principal cross section of about ¾ of an inch in width and around 6/10th of an inch in height. By providing for adjustable mounting of side elements in overlapping passages in the display supports, a maximum range of adjustability for package sizes is provided. The balance of the display unit is made up of elemental wire sections comprising the main frame and the side supports, so that both production of compartments and the assembly thereof are easy and economical.

The system of the invention readily incorporates pusher means for maintaining forward package positioning, where such is desired. In one form, a preassembled pusher mechanism is simply snapped into place on opposite end wires of the main frame. In another embodiment, the longitudinal wires of the main frame serve as guide tracks for mounting and guiding a pusher sled.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. An adjustable width product display system, which comprises one or more product display units, each having a front and a back and each comprising (a) a product support structure comprising spaced apart wire product support elements extending longitudinally from front to back of the display unit, (b) each said product display unit having longitudinally spaced apart front and back display supports engaging and supporting said product support structure, (c) said product display unit having a front-to-back longitudinal axis, and said front and back display supports extending generally transversely to said axis, (d) said display supports being formed of molded plastic material, (e) said front and back display supports each have upwardly opening grooved portions therein for the snap-in assembly and retention in fixed relation to said longitudinally extending wire product support elements, (f) said display supports having a width dimension and being formed with first and second overlapping adjacent transverse recesses therein extending substantially throughout the full width dimension of the display supports, (g) first and second product side supports formed of wire and disposed on opposite sides of said display units, (h) each of said product side supports including front and back, transversely disposed mounting elements, formed of wire, extending for a length substantially as great as the width dimension of said display supports, and received for independent transverse slideable adjustment within one of said transverse recesses in each of said front and back display supports, (i) the respective front and back mounting elements of one product side support being received in transverse recesses of the display supports different from the transverse recesses in which mounting elements of the other product side support are received, such that the mounting elements of the respective product side supports, in certain adjusted positions thereof, can be positioned in overlapping relation.

2. A product display system according to claim 1, wherein said display supports are formed of an acetal polymer suitable for low temperature environment of a food freezer.

3. An adjustable width product display system according to claim 1, wherein (a) there are two or more such product display units positioned in side-by-side relation, (b) between each two adjacent such product display units there is a single, intermediate product side support, (c) said intermediate product side support comprises front and back transverse wire sections adjustably connected to display supports of the two adjacent product display units, joining said adjacent units together in adjustably spaced relation, (d) said intermediate product side supports each comprising an element extending between said front and back transverse wire sections and serving as a side support.

4. An adjustable width product display system, which comprises one or more product display units, each having a front and a back and each comprising (a) a product support structure comprising spaced apart wire product support elements extending longitudinally from front to back of the display unit, (b) longitudinally spaced apart front and back display supports engaging and supporting said product support structure, (c) said product display unit having a front-to-back longitudinal axis, and said front and back display supports extending generally transversely to said axis, (d) said display supports being formed of molded plastic material, (e) said front and back display supports being joined in fixed relation to said longitudinally extending wire product support elements, (f) said display supports being formed with first and second overlapping adjacent transverse recesses therein, (g) first and second product side supports formed of wire and disposed on opposite sides of said display units, (h) each of said product side supports including front and back, transversely disposed mounting elements, formed of wire and received for transverse slideable adjustment within one of said transverse recesses in each of said front and back display supports, (i) the respective front and back mounting elements of one product side support being received in transverse recesses of the display supports different from the transverse recesses in which mounting elements of the other product side support are received, such that the mounting elements of the respective product side supports, in certain adjusted positions thereof, can be positioned in overlapping relation, (j) said front and back display supports each having upwardly opening grooved portions therein for the snap-in assembly and retention of said product support structure, (k) said product support structure including a pair of transverse wire elements connecting front and back end portions of said longitudinally extending wire product support elements, and (l) the upwardly opening grooved portions of said front and back display supports comprising transversely extending grooves therein for the snap-in assembly of the transverse wire elements.

5. An adjustable width product display system, which comprises one or more product display units, each having a front and a back and each comprising (a) a product support structure comprising spaced apart wire product support elements extending longitudinally from front to back of the display unit, (b) each said product display unit having longitudinally spaced apart front and back display supports engaging and supporting said product support structure, (c) said product display unit having a front-to-back longitudinal axis, and said front and back display supports extending generally transversely to said axis, (d) said display supports being formed of molded plastic material, (e) said front and back display supports each have upwardly opening grooved portions therein for the snap-in assembly and retention in fixed relation to said longitudinally extending wire product support elements, (f) said display supports having a width dimension and being formed with first and second overlapping adjacent transverse recesses therein extending throughout more than one-half of the width dimension of the display supports, (g) first and second product side supports formed of wire and disposed on opposite sides of said display units, (h) each of said product side supports including front and back, transversely disposed mounting elements, formed of wire, extending for a length greater than one-half the width dimension of said display supports, and received for independent transverse slideable adjustment within one of said transverse recesses in each of said front and back display supports, (i) the respective front and back mounting elements of one product side support being received in transverse recesses of the display supports different from the transverse recesses in which mounting elements of the other product side support are received, such that the mounting elements of the respective product side supports, in certain adjusted positions thereof, can be positioned in overlapping relation.

* * * * *